US005373715A

United States Patent [19]

Sharp et al.

[11] Patent Number: 5,373,715

[45] Date of Patent: Dec. 20, 1994

[54] ROTATABLE WASH BASKET FOR AN AUTOMATIC WASHER

[75] Inventors: Brenner M. Sharp, St. Joseph Township, Berrien County; Eric K. Farrington, Lincoln Township, Berrien County; Jefrey A. Lynn, St. Joseph Township, Berrien County, all of

[73] Assignee: Whirlpool Corporation, Benton Harbor, Mich.

[21] Appl. No.: 985,045

[22] Filed: Dec. 3, 1992

[51] Int. Cl.[5] ..... D06F 39/12

[52] U.S. Cl. ..... 68/23 R; 68/133; 68/174

[58] Field of Search ..... 68/174, 23.3, 131, 133, 68/23 R

[56] References Cited

U.S. PATENT DOCUMENTS

| | | | |
|---|---|---|---|
| 1,949,235 | 2/1934 | Behan | 68/174 |
| 2,167,147 | 7/1939 | Frantz | 68/174 |
| 3,548,617 | 12/1970 | Wasemann | 68/133 |
| 3,603,118 | 9/1971 | Brucker et al. | 68/174 |
| 4,216,663 | 8/1980 | Shacklock | 68/3 R |
| 4,444,027 | 4/1984 | Ikeda | 68/23.6 |
| 4,483,161 | 11/1984 | Oida | 68/23.6 |
| 5,012,658 | 5/1991 | Shikamori et al. | 68/12.01 |

FOREIGN PATENT DOCUMENTS

| | | | |
|---|---|---|---|
| 60-156490 | 8/1985 | Japan | 68/174 |

*Primary Examiner*—Frankie L. Stinson

*Attorney, Agent, or Firm*—Joel M. Van Winkle; Stephen D. Krefman; Robert O. Rice

[57] ABSTRACT

An automatic washing machine having a imperforate stationery tub and further having a rotatable plastic wash basket, for receiving a clothes load, disposed within the stationary tub. The rotatable plastic wash basket further includes a cylindrical outer wall having an upper end open for receiving the clothes load. A base integral with the cylindrical outer wall is provided for forming a bottom of the rotatable basket. An annular core member is disposed within the base of the plastic wash basket such that the base encapsules and interlocks with the annular core member. In addition, a hub member is disposed centrally in the annular core member and is drivingly connectable with a drive shaft for drivingly rotating said rotatable wash basket. The annular core member has a substantially triangular radial cross-section such that the base is optimally configured to form a solid triangular radial cross-section for providing strength and rigidity to the wash basket. Alternately, a combined core member may be disposed within the base, combining the function of the hub member and the annular core member into one integral member.

24 Claims, 3 Drawing Sheets

ROTATABLE WASH BASKET FOR AN AUTOMATIC WASHER

BACKGROUND OF THE INVENTION

1. Field of the Invention.

The present invention relates to a washing machine and more particularly to a rotatable plastic wash basket having sufficient rigidity to prevent undue vibration and deflection.

2. Description of the Prior Art.

Rotatable wash baskets for use in automatic washers may be subject to various types of forces during basket spin and may have particular dynamic responses to forced vibrations which may occur during basket spin. The types of forces experienced by the basket typically include a centrifugal force created by an evenly distributed load of clothes, a localized imbalance force created by an unevenly distributed load of clothes and a reactive force applied at the top lip of the basket by spinning water in a balance ring. The wash basket is typically supported by a hub member which is interconnected with a drive shaft for supporting and rotating the wash basket. The localized imbalance force resulting from an unevenly distributed load of clothes creates a moment at the hub member, and if uncorrected, may create undesired vibration in the wash basket during rotation. Preferably, the reactive force resulting from the spinning water in the balance ring will create a substantially equal and opposite moment at the hub member for correction of the localized imbalance such that undesired vibration is prevented. An eccentric spin condition must exist for the balance ring to function therefore some small difference typically exists between the moment created by the reactive force at the hub member and and the moment created by the localized imbalance force at the hub member. However, due to physical size limitations in the balance ring, in the case of large localized imbalance forces large differences in moments may exist. These differences result in an overall imbalanced condition for the wash basket which subjects the rotating wash basket to forced vibrations during spin. These forced vibrations will have a frequency equal to the spin frequency (basket revolutions/sec) of the rotatable wash basket.

Typically, rotatable wash baskets for use in an automatic washer are constructed of metal. For example, U.S. Pat. No. 4,890,465 shows a metallic rotatable wash basket having a single wall basket structure including a single wall base structure. U.S. Pat. No. 2,921,460 shows a metallic rotatable wash basket having a single wall basket structure including a single wall base structure having an additional rigid metallic bottom plate attached to the base for providing base rigidity. Because of the inherent stiffness and strength of metal, rotatable wash baskets made of metal are sufficient to withstand the various forces to which a rotatable wash basket may be subjected.

It is also well known to utilize plastic rotatable wash baskets in an automatic washer. The use of a plastic material for a rotatable wash basket may offer various advantages over metal including lower cost and corrosion resistance. However, the strength of plastic is such that simple single wall wash basket construction, similar to metallic wash basket designs, may not have adequate strength and stiffness. Plastic processing limitations prevent wash basket designers from simply increasing the thickness of the plastic walls to improve wash basket strength. Therefore, to provide adequate strength and stiffness in a plastic basket, various wash basket reinforcement configurations are employed. These wash basket reinforcement configurations are typically intended to provide additional strength to the bottom or base of the wash basket. In particular, the prior art shows the use of reinforcing ribs located on the base of a plastic rotatable wash basket or the use of a rigid metallic bottom plate attached to the base of a plastic rotatable wash basket.

For example, U.S. Pat. No. 5,012,658 illustrates the use of reinforcing ribs located on the base of a rotatable plastic wash basket for providing the necessary strength and stiffness. The use of reinforcing ribs, however, may have several disadvantages. The use of external ribs on the base of a wash basket may cause the formation of an undue amount of suds between the rotatable basket and an imperforate, non-rotatable tub. This suds condition may cause the automatic washer to fail to adequately perform various functions. Furthermore, ribbed base designs may still not offer equivalent strength and stiffness as compared to metallic wash baskets having metallic base structures and rotatable plastic basket having a ribbed base may be inadequate to withstand the various forces to which a rotating wash basket is subjected.

Additionally, U.S. Pat. No. 4,483,161 and U.S. Pat. No. 4,444,027 illustrate the use of a metal reinforcing plate secured to the base of a plastic rotating wash basket for providing the required stiffness and strength. The use of a metallic reinforcing plate may also have several disadvantages. The use of a reinforcing plate requires the use of fasteners which increases the difficulty of assembly. In addition, a metallic reinforcing plate may create corrosion problems. Finally, the addition of a reinforcing plate and fasteners may increase the cost of the rotatable wash basket.

In both plastic and metallic rotatable wash baskets, the deflection and the dynamic response of the rotatable wash basket may be influenced by several factors including the overall stiffness of the wash basket. In particular, the basket should preferably be designed such that the lowest natural frequency of the wash basket structure is greater than the spin frequency of the rotatable wash basket so that undue vibration may be avoided. Given the inherent stiffness and strength of metal, undue deflection or vibration has typically not been an issue in the design of metallic baskets. Typically, the lowest natural frequency of a metallic basket is higher than the spin frequency of the basket and therefore excitation of the basket at its natural frequency is avoided. However, since plastic has less inherent strength and stiffness than metal, plastic baskets typically require reinforced structure to prevent undue deflection and vibration.

Engineering analysis performed by the inventors has shown that the base which forms the bottom wall of the basket is critical in dictating the stiffness of the entire basket. Therefore, a plastic rotatable wash basket having a base geometry which provides adequate stiffness to the entire basket may provide a basket design having its lowest natural frequency higher than the spin frequency of the basket such that undue vibrations are not experienced during basket spin. Prior art, however, appears to teach the use of relatively thick walls in the vertical cylindrical portion of the plastic wash basket for achieving stiffness and strength. This manner of providing basket stiffness for preventing undue deflection and vibration is relatively ineffective and expensive. Therefore, a basket having a base geometry which provides adequate stiffness may have a cylindrical outerwall portion of the basket having a wall thickness less than a wash basket having a base with inadequate stiffness such that a basket having an adequately stiff base may use less material than a basket having an inadequately stiff base.

There is, therefore, a need for a plastic rotatable wash basket for use in an automatic washer having a structure sufficient to withstand the forces applied to the basket, but which does not create a sudsing problem or require additional reinforcing plates. Additionally, there is a need for a plastic rotatable wash basket having a base sufficiently stiff such that the lowest natural frequency of the rotatable basket is greater than the spin frequency of the rotatable wash basket. Furthermore, there is a need for a plastic basket construction which minimizes the basket wall thickness thereby being of relatively low cost.

SUMMARY OF INVENTION

Accordingly, an object of the invention is to provide an automatic washer having a rotatable plastic wash basket having a base structure sufficient to accommodate the various forces applied to the basket. Another object is to provide a rotatable plastic wash basket having a lowest natural frequency greater than the spin frequency of the basket. A further object is to provide a rotatable plastic wash basket having a base structure which does not cause the formation of an undue amount of suds between the rotatable wash basket and an imperforate stationary wash tub. A still further object of the invention is to provide a rotatable plastic wash basket meeting the above described objectives and being of relatively low cost, being relatively easy to assemble and not requiring any additional metal reinforcing plates.

To achieve these objects, according to the invention, there is provided an automatic washing machine having a imperforate stationery tub and further having a rotatable plastic wash basket, for receiving a clothes load, disposed within the tub. The rotatable plastic wash basket further comprises a cylindrical outer wall defining a vertical axis and having an upper end open for receiving the clothes load. A base integral with the cylindrical outer wall is provided for forming a bottom of the rotatable basket. A hub member is positioned centrally in the base and is drivingly connectable with a drive shaft for rotating said rotatable wash basket. The base further includes an annular core member, formed within the base, which surrounds the hub member. The annular core member has a substantially triangular radial cross-section such that the base is optimally configured to form a solid triangular radial cross-section for providing strength and rigidity to the wash basket.

Alternately, a combined core member may be disposed within the base, combining the function of the hub member and the annular core member into one integral member.

Other objects of the invention may become clear to those skilled in the Art, from the following description of the preferred embodiments when taken in conjunction with the following drawings.

DESCRIPTION OF THE PREFERRED EMBODIMENTS

Figure 1:
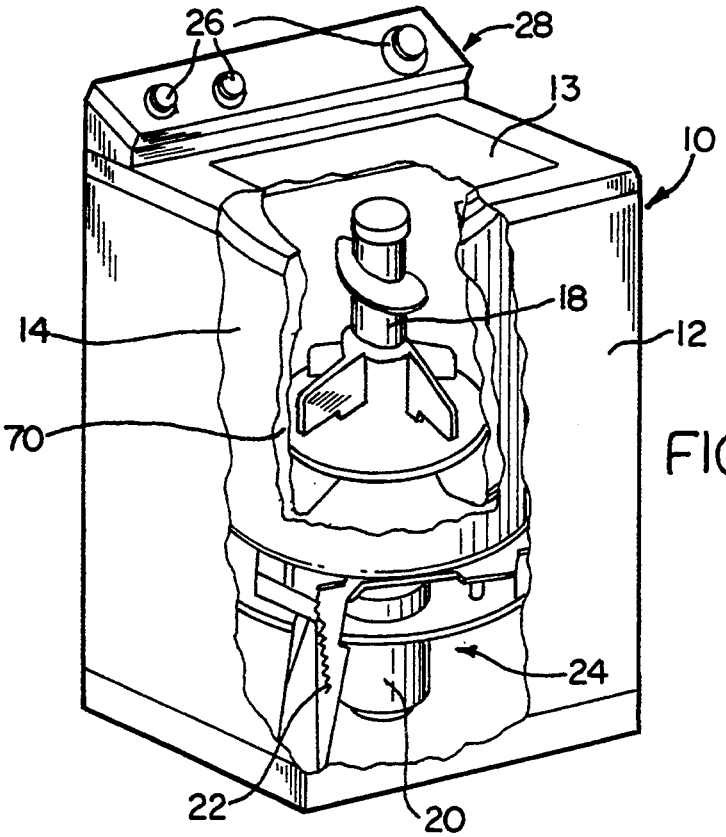
FIG. 1 is a perspective view of an automatic washer embodying the principles of the present invention.

In FIG. 1 there is illustrated an automatic washer 10 embodying the principles of the present invention. The washer 10 has an outer cabinet 12 with an openable lid 13 which encloses an imperforate wash tub 14 for receiving a supply of wash liquid. Concentrically mounted within the wash tub 14 is a plastic wash basket 70, further described hereinbelow, for receiving a load of materials to be washed, and further mounted within the wash basket 70 is a vertical axis agitator 18. A motor 20 is provided which is drivingly connected through a drive system 24 to the vertical axis agitator 18 to drive it in an oscillatory or rotary manner and is also selectively connectible to the plastic wash basket 70 to drive it in a rotary manner. The assembly of wash tub 14, wash basket 70, agitator 18, drive system 24 and motor 20 is mounted on a suspension system 22. A plurality of controls 26 are provided on a control console 28 for automatically operating the washer through a series of washing, rinsing and liquid extracting steps as is well known in the art.

Figure 2:
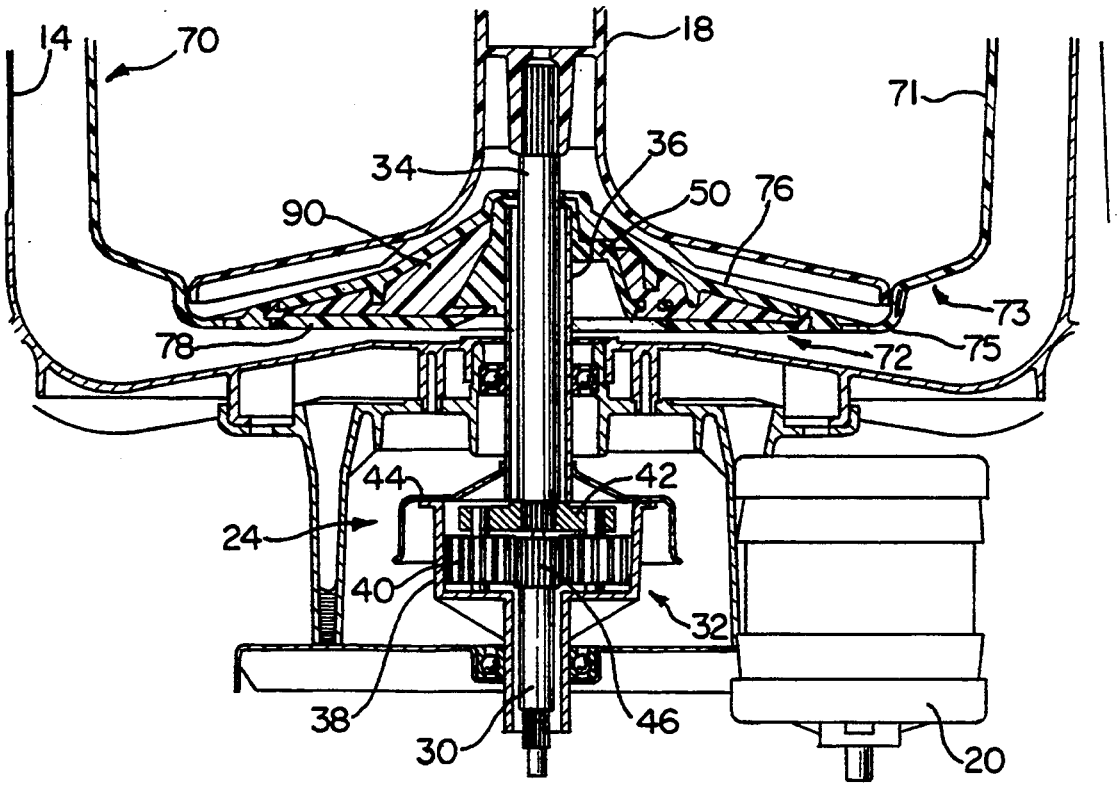
FIG. 2 is a partial sectional view of the agitator and wash basket and drive system of the washer of FIG. 1.

Portions of the drive system 24 and the plastic wash basket 70 of the present invention are shown in greater detail in FIG. 2 where it is seen that the motor 20 is operably connected to a drive shaft 30 which, through a gear arrangement such as a planetary gear assembly 32, drives a vertical shaft 34 drivingly connected to the vertical axis agitator 18. The plastic wash basket 70 is connected via a spin tube 36 to an agitator ring gear 38 of the planetary gear assembly 32 having an external generally cylindrical hub surface 44. The vertical shaft 34 is connected to a planet gear 40 through the use of a connecting carrier plate 42. A sun gear 46 is directly connected to the drive shaft 30. The drive system described above and illustrated in the appended drawings is an exemplary embodiment of a known drive system as can be found in U.S. Pat. No. 4,890,465.

The plastic wash basket 70 is shown having a generally cylindrical outer wall 71 defining a vertical axis. The generally cylindrical outer wall 71 has an upper end open for receiving clothes and a lower end 73. A base 72, having and outer edge 75 interconnected with the lower end 73 of the cylindrical outer wall 71, is provided for forming a bottom of the wash basket 70. An annular core member 90, having a generally triangular radial cross-section, is disposed within the base 72 such that the base 72 is configured to have a first wall 76 disposed above the annular core member 90 and a second wall 78 disposed below the annular core member 90. The first wall 76 and the second wall 78 are configured to have an optimum shape for providing stiffness and strength to the wash basket 70. A hub member 50 is centrally positioned within the annular core member 90 for rigidity interconnecting with the spin tube 36.

Figure 4:
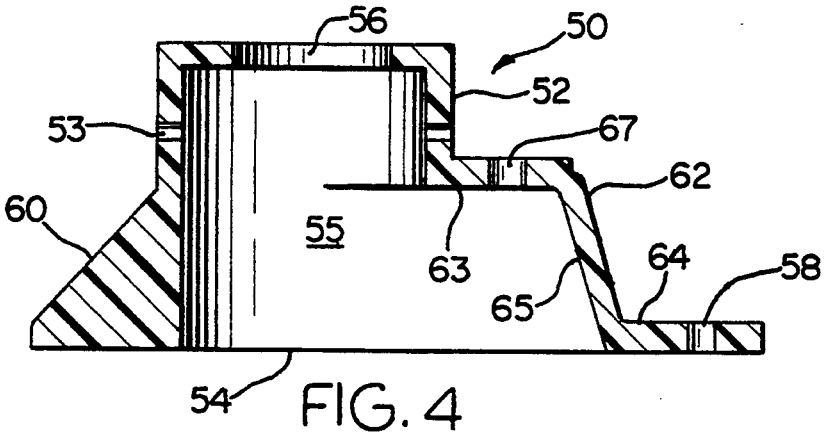
FIG. 4 is a sectional view of the hub member taken along lines 4—4 of FIG. 3.
Figure 3:
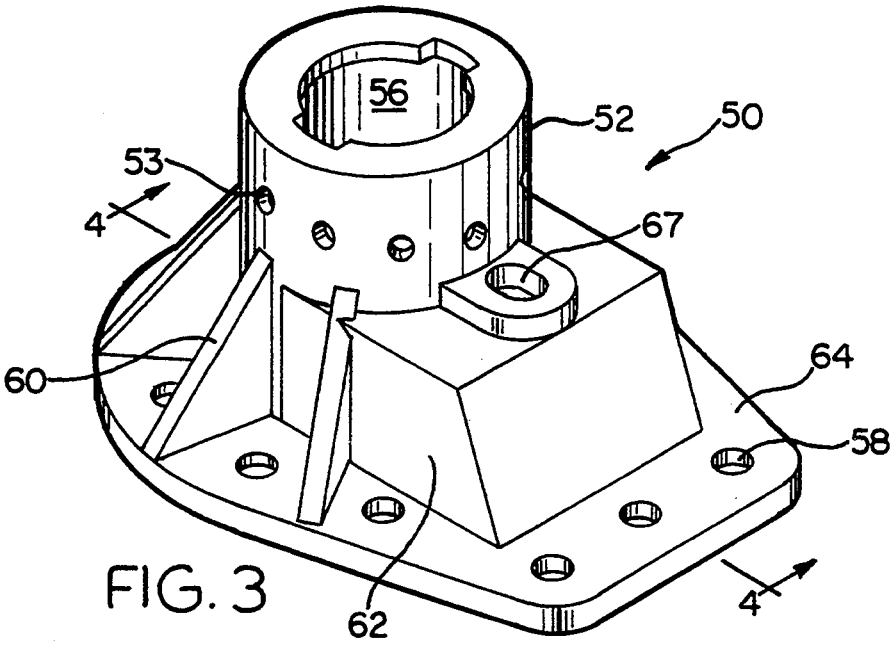
FIG. 3 is a perspective view of the hub member of the present invention.

The hub member 50 is shown in greater detail in FIG. 3 and FIG. 4. The hub member 50 includes a generally cylindrical hollow portion 52 defining a vertical axis, coaxial with the generally cylindrical outer wall 71, having an upper end and a lower end. A substantially rectangular hollow portion 62, having an open bottom, intersects the lower end of the cylindrical hollow portion 52. A flange portion 64, perpendicular to the vertical axis defined by the cylindrical hollow portion 52, extends from the lower end of the cylindrical hollow portion 52 and the open bottom of the rectangular hollow portion 62 perpendicular to the vertical axis of the cylindrical hollow portion 52.

The cylindrical hollow portion 52 and the rectangular hollow portion 62 define an interior cavity 55 having an open bottom end 54 and an open top end 56. The lower portion of the interior cavity 55 has a cross-section, perpendicular to the vertical axis defined by the cylindrical hollow portion 52, having the shape of a rectangle having a semi-circular, rounded end. The upper portion of the interior cavity 55 has a substantially circular cross-section perpendicular to the vertical axis defined by the generally cylindrical hollow portion 52.

The interior cavity 55 of the hub member 50 is substantially identical and performs a utility substantially similar to a known apparatus for cooperating with a spin tube for rotating a metallic basket and is therefore only briefly described below. The open bottom end 54 of the cavity 55 allows insertion of the spin tube 36 such that the spin tube 36 is driveably connectible with the hub member 50. Additionally, the open bottom end 54 of the cavity 55 allows insertion of a pillow block (not shown) which may be drawn up toward a top surface 63 of the rectangular hollow portion 62 by a bolt (not shown) which extends through a hole 67 into a threaded hole of the pillow block. The pillow block may therefore be wedged between the inner surface of an angular wall 65 of the rectangular hollow portion 62 and the spin tube 36 such that the hub member 50 is securely connected to the spin tube 36. The open top end 56 of the cavity 55 allows the vertical shaft 34 to extend through the hub member 50 for driveable interconnection with the agitator 18.

In addition to having means for rigidly connecting with the spin tube 36, the configuration of hub member 50 also provides means for mechanically interlocking the hub member 50 with the annular core member 90. In the preferred embodiment contemplated by the inventor, the annular core member 90 is a plastic member molded around the hub member 50. Therefore, the hub member 50 becomes mechanically locked with the annular core member 90. Various external features of the hub member 50 provide means for further enhancing this mechanical interlocking such that the hub member 50 may drivingly rotate and vertically support the annular core member 90 thereby drivingly rotating and vertically supporting the wash basket 70.

A first means for mechanical interlocking the hub member 50 with the annular core member 90 is provided by a plurality of external axial ribs 60, extending from the cylindrical hollow portion 52 of the hub member 50. A second means for mechanical interlocking the hub member 50 with the annular core member 90 is provided by a plurality of holes 58, coaxial with the cylindrical hollow portion 52 are located on the flange portion 64. A third means for mechanically interlocking the hub member 50 with the annular core member 90 is provided by a plurality of angularly spaced holes 53, extending radially through the upper end of the cylindrical hollow portion 52. The first means, the second means and the third means for mechanically interlocking the hub member 50 with the annular core member 90 provide contact surfaces between the hub member 50 and the annular core member 90 which oppose relative rotary movement between the hub member 50 and the core member 90. The flange portion 64 provides a fourth means for interlocking the hub member 50 with the annular core member 90 for vertically supporting the wash basket 70 by providing a contact surface between the hub member 50 and the annular core member 90 which opposes relative vertical movement between the hub member 50 and the annular core member 90. Rigid mechanical interlocking between the hub member 50 and the annular core member 90 is further enhanced by the inherent tendency of plastic to shrink during molding such that the annular core member 90 shrinks around the hub member 50 during the molding.

Figure 6:
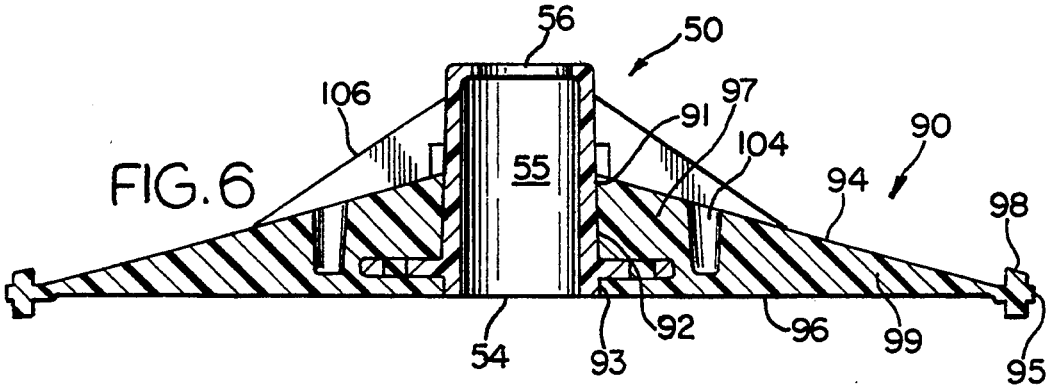
FIG. 6 is a sectional view taken along line 6—6 of FIG. 5.
Figure 5:
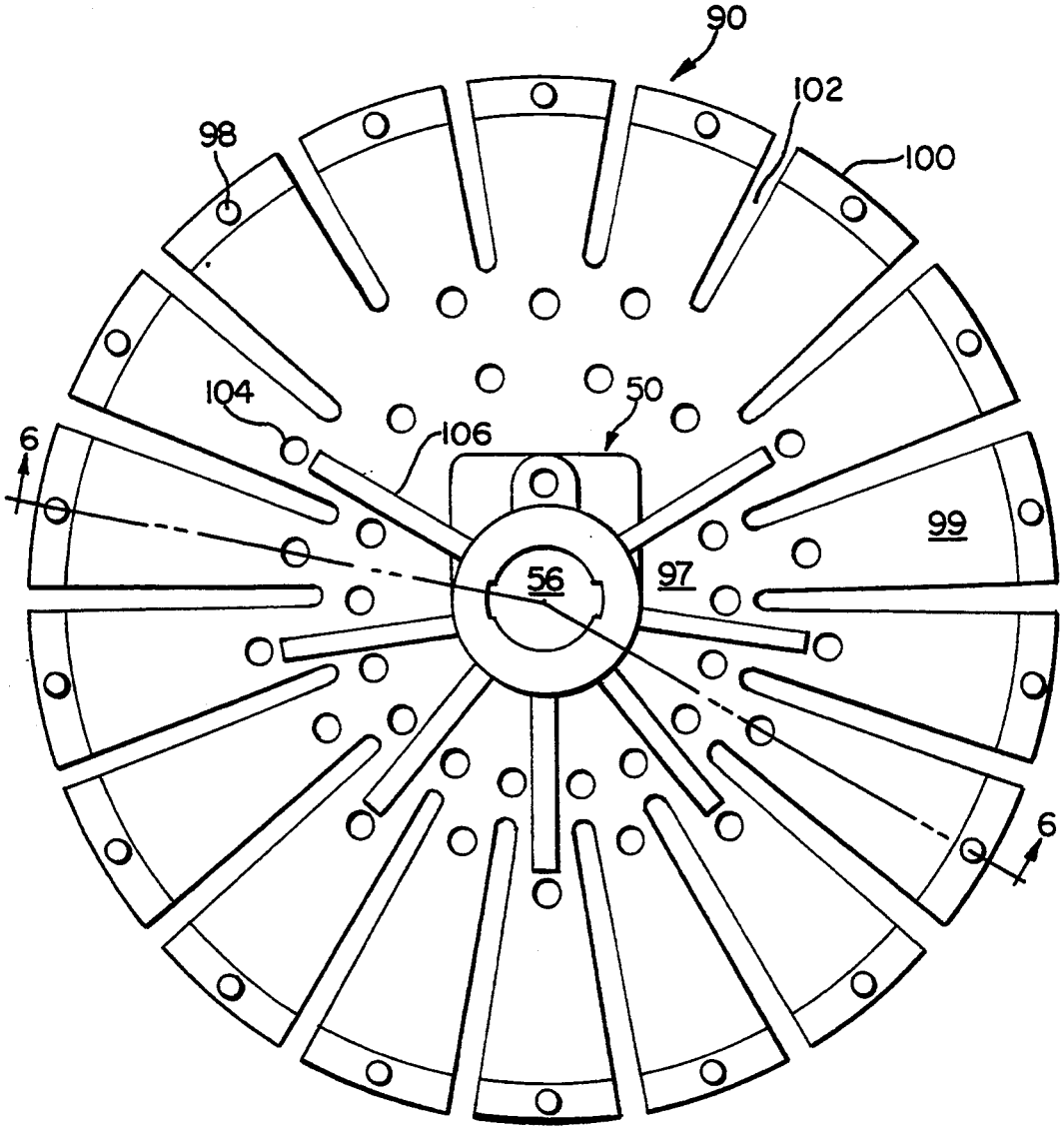
FIG. 5 is a top elevational view of the assembly of the annular core member and the hub member of the present invention.

The assembly of the annular core member 90 and the hub member 50 is shown in FIG. 5 and FIG. 6. As illustrated, the annular core member 90 has a single integral body surrounding the hub member 50. As mentioned above, in the preferred embodiment contemplated by the inventor, the annular core member 90 is molded around the hub member 50 using a plastic resin. Since the annular core member's primary utility is in configuring the base 72 of the wash basket 70 into an optimal shape for providing stiffness and strength, it is contemplated by the inventors that the lowest cost available plastic resin may be utilized for the annular core member 90. Furthermore, techniques, known by plastic processors skilled in the art, for foaming internal portions of the annular core member 90 may be utilized to reduce the amount of materials used for fabricating the annular core member 90 thereby reducing costs.

In FIG. 5 it can be seen that the annular core member 90 is formed having an outer annular portion 99 and an inner annular portion 97. The outer annular portion is formed from a plurality of angularly spaced extensions 100. A plurality of positioning bosses 98 are disposed on the outermost point of the angularly spaced extensions 100. The inner annular portion 97 of the annular core member 90 is a continuous solid portion surrounding the hub member 50.

The cross-sectional view of FIG. 6 illustrates the substantially triangular radial cross-section of the annular core member 90. As illustrated, a first surface 92, having an upper end 91 and a lower end 93, is disposed adjacent the hub member 50 and mechanically interlocks with the hub member 50. A second surface 96 extends outwardly from the lower end 93 of the first surface 92 perpendicular to the vertical axis defined by the cylindrical hollow portion 52 of the hub member 50, to a predetermined point 95. A third surface 94 extends generally from the predetermined point 95 of the second surface 96 to the upper end 91 of the first surface 92.

In the preferred embodiment, the inventors contemplate the annular core 90 being disposed within the base 72 in substantially similar fashion to the manner in which the hub member 50 is disposed within the annular core member 90. The base 72, therefore, is preferably molded around the assembly of the annular core member 90 and the hub member 50, thereby mechanically interlocking the assembly of the core member 90 and the hub member 50 within the base 72 of the wash basket such that the rotating motion of the spin tube 36, which is transferred through the hub member 50 into the annular core member 90, may be transferred to the base 72.

Various external features of the annular core member provide means for further enhancing mechanical interlocking between the annular core member 90 and the base 72. A plurality of angular spaced slots 102, disposed between the angularly spaced extensions 100, provide a first means for mechanically interlocking the annular core member 90 with the base 72. A plurality of radial ribs 106, extending upwardly from the third surface 94 of the annular core member 90 and intersecting the upper portion of the cylindrical hollow portion 52 of the hub member 50, provide a second means for mechanically interlocking with the base 72. The plurality of radial ribs 106, further correspond with the angularly spaced holes 53 disposed on the hub member 50. Finally, a plurality of core holes 104, extending into the third surface 94 of the annular core member 90, provide a third means for mechanically interlocking the annular core member 90 with the base 72. Besides providing a third means for mechanically interlocking with the base 72, the plurality of core holes 104 extending into the third surface 94 of the annular core member 90 assist in the fabrication of the annular core member 90 by reducing the amount of material used in the annular core member 90 and providing thermal sinks during processing. Rigid mechanical interlocking between the annular core member 90 and the base 72 is further enhanced by the inherent tendency of plastic to shrink during molding such that the base 72 shrinks around the annular core member 90 during the molding.

It is contemplated by the inventors that the wash basket 70 may be fabricated in the following fashion. The hub member 50 is initially formed, preferably by casting. Secondary machining operations may be performed as required on the hub member 50 to provide the needed machined interior surfaces for contacting the spin tube 36. The finished hub member 50 may then be positioned within an annular core member mold for fabricating the annular core member 90. A gate for filling the annular core member mold with plastic resin is constructed to allow molten plastic resin to flow through the angularly spaced holes 53 located on the cylindrical hollow member 52 of the hub member 50 into the annular core member mold such that the angularly spaced holes 53 effectively serve as gates for the annular core member mold and the angularly spaced radial ribs 106 serve as runners for the molten plastic resin such that the annular core member mold fills with plastic resin evenly. A completed annular core assembly, including the annular core member 90 and the hub member 50, is then positioned within a wash basket mold. Means are provided for radially locating the annular core assembly within the wash basket mold while the plurality of the positioning bosses 98 disposed on the outermost portion of the annular core member extensions 100 provide axial positioning. Molten plastic is forced into the wash basket mold such that the basket walls are formed, and in particular the first wall 76 and the second wall 78 of the base 72 of the wash basket 70 are formed around the annular core member 90 and hub member 50 assembly.

Figure 7:
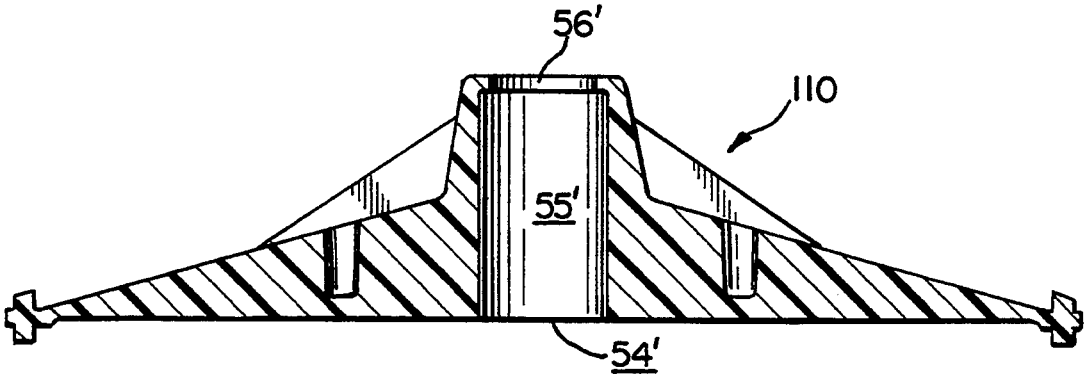
FIG. 7 is a sectional view, similar to FIG. 6, illustrating a combined core member configuration combining the functions of the hub member and the annular core member of the present invention.

A combined core member 110 may be alternately constructed for combining the function of the hub member 50 and the annular core member 90. The core member 110 is shown in FIG. 7 having a substantially identical outer surface as the annular core member 90 but omitting the hub member 50. The core 110 may be constructed having an interior cavity 55' substantially identical to the interior cavity 55 of the hub member 50. The interior cavity 55' has an open top end 56' and an open bottom end 54' and interconnects with the spin tube 36 in substantially the same manner as the hub member 50 for supporting and rotatably driving the plastic wash basket 70.

The above described configuration of wash basket 70, therefore, provides a novel structure of wash basket 70 which gives the wash basket 70 required stiffness and strength. While providing stiffness and strength, the wash basket configuration does not cause the formation of an undue amount of suds between the wash basket 70 and wash tub 14. Additionally, no metallic reinforcing plate is required to provide strength to the base 72. Furthermore, the above described novel wash basket 70 has a base 72 having a relatively high degree of stiffness and strength as compared to known commercial plastic wash baskets and therefore may utilize a relatively thin outer cylindrical wall 71 such that less material is required for producing the wash basket 70.

Although the present invention has been described with reference to a specific embodiment, those of skill in the Art will recognize that changes may be made thereto without departing from the scope and spirit of the invention as set forth in the appended claims.

We claim:

1. A rotatable wash basket for use with an automatic washer, said wash basket comprising:

an integral plastic body, said integral plastic body further including:

a generally cylindrical outerwall defining a vertical axis and further having an upper end open for receiving clothes for wash treatment and a lower end, and a base having an outer edge integral with said lower end of said generally cylindrical outerwall, said base forming a cavity; and an annular core assembly disposed within said cavity of said base such that said annular core assembly is encapsulated and interlocked within said base such that the stiffness of said base is increased, said annular core assembly further having means for rigidly interconnecting with a drive shaft for rotating said wash basket.

2. A rotatable wash basket according to claim 1, wherein said annular core assembly further comprises:

an annular core member; and a hub member disposed centrally within said annular core member such that said annular core member is interlocked with said hub member, said hub member further having means for rigidly connecting with said drive shaft for rotating said wash basket.

3. A rotatable wash basket according to claim 2, wherein said hub member further comprises:

a generally cylindrical hollow portion having an axis aligned with said vertical axis, and having a top end and a bottom end; and a substantially rectangular hollow portion intersecting said generally cylindrical hollow portion and having an open bottom corresponding to said lower end of said generally cylindrical hollow portion such that said generally cylindrical hollow portion and said substantially rectangular hollow portion define an interior cavity of said hub member having an open top end and open bottom end and further having a lower portion having a substantially rectangular cross-section and an upper portion having a substantially circular cross-section, said interior cavity further including means for rigidly interconnecting with said drive shaft.

4. A rotatable wash basket according to claim 3, wherein said hub member is metallic.

5. A rotatable wash basket according to claim 3, further comprising a plurality of external axial ribs.

6. A rotatable wash basket according to claim 3, further comprising a flange portion intersecting said bottom end of said generally cylindrical hollow portion of said hub member, said flange including a plurality of holes extending therethrough.

7. A rotatable wash basket according to claim 3 wherein said generally cylindrical hollow portion of said hub member further comprises an upper portion having a plurality of angularly spaced holes radially extending through said generally cylindrical hollow portion.

8. A rotatable wash basket according to claim 2, wherein said annular core member having an integral annular body further comprises:

a plurality of surfaces defining said integral annular body, said plurality of surfaces further comprising:

a first annular surface formed along said hub having an upper and lower end;

a second annular surface substantially perpendicular to said vertical axis of said cylindrical member and extending outward from said lower end of said first annular surface toward said outer edge of said base; and a third annular surface interconnected with said second annular surface and extending at an acute angle upward and inward to said upper end of said first annular surface such that said first annular surface, said second annular surface and said third annular surface interconnect for forming a substantially triangular radial cross-section of said annular core member.

9. A rotatable wash basket as claimed in claim 8 wherein said base encapsulating said annular core member further comprises:

a first wall disposed below and interlocked with said second annular surface; and a second wall disposed above and interlocked with said third annular surface such that a vertical downward force applied to said outer edge of said base is opposed by placing said first wall in compression and said second wall in tension for eliminating bending and increased base rigidity.

10. A rotatable wash basket as claimed in claim 8 wherein said annular core member further comprises:

a plurality of angularly spaced radial ribs extending from said third annular surface for enhancing interlocking between said annular core member and said base;

a plurality of core holes extending into said third annular surface for reducing material usage in fabrication said annular core member and for enhancing interlocking between said annular core member and said base; and a plurality of positioning bosses disposed at the outermost point of said angularly spaced radial extensions for positioning said annular core member during said plastic wash basket fabrication.

11. A rotatable wash basket according to claim 2, wherein said annular core member is plastic and is molded around said hub member.

12. A rotatable wash basket according to claim 1, wherein said annular core assembly further comprises:

a plurality of surfaces defining an integral annular body, said plurality of surfaces further comprising:

a first annular surface having an upper and lower end;

a second annular surface substantially perpendicular to said vertical axis of said cylindrical outerwall and extending outward from said lower end of said first annular surface toward said outer edge of said base; and a third annular surface interconnected with said second annular surface and extending at an acute angle upward and inward to said upper end of said first annular surface such that said first annular surface, said second annular surface and said third annular surface interconnect forming a substantially triangular radial cross-section of said annular core assembly.

13. A rotatable wash basket as claimed in claim 12 wherein said base encapsulating said annular core assembly further comprises:

a first wall disposed below and interlocked with said second annular surface; and a second wall disposed above and interlocked with said third annular surface such that a vertical downward force applied to said outer edge of said base is opposed by placing said first wall in compression and said second wall in tension for eliminating bending and increased base rigidity.

14. A rotatable wash basket for use with an automatic washer, said wash basket comprising:

an integral plastic body, said integral plastic body further including:

a generally cylindrical outerwall defining a vertical axis and further having an upper end open for receiving clothes for wash treatment and a lower end, and a base for forming a bottom of said generally cylindrical outerwall and having an outer edge integral with said lower end of said generally cylindrical outerwall said base forming a cavity; and a combined core member disposed centrally within said cavity of said base, such that said combined core member is encapsulated and interlocked within said base such that the stiffness of said base is increased, said combined core member having means for rigidly interconnecting with a drive shaft for rotating said wash basket.

15. A rotatable wash basket according to claim 14, wherein said combined core member further comprises:

an interior cavity disposed centrally within said combined core member and having an open top end and open bottom end and further having a lower portion having a substantially rectangular cross-section and an upper portion having a substantially circular cross-sections said interior cavity including said means for rigidly connecting with said drive shaft.

16. A rotatable wash basket according to claim 15, wherein said combined core member further comprises:

a plurality of surfaces defining an integral annular body, said plurality of surfaces further comprising:

a first annular surface defining said interior cavity of said combined core member, said first annular surface further having an upper end and a lower end;

a second annular surface substantially perpendicular to said vertical axis of said cylindrical member and extending outward from said lower end of said first annular surface toward said outer edge of said base; and a third annular surface interconnected with said second annular surface and extending at an acute angle upward and inward to said upper end of said first annular surface such that said first annular surface, said second annular surface and said third annular surface interconnect for forming a substantially triangular radial cross-section.

17. A rotatable wash basket as claimed in claim 16 wherein said base encapsulating said annular core member further comprises:

a first wall disposed above and interlocked with said second annular surface; and a second wall disposed below and interlocked with said third annular surface such that a vertical downward force applied to said outer edge of said base is opposed by placing said first wall in compression and said second wall in tension for eliminating bending and increased base rigidity.

18. A rotatable wash basket according to claim 16, wherein said combined core member further comprises:

a plurality of angularly spaced radial ribs extending from said third annular surface for enhancing interlocking between said combined core member and said base;

a plurality of core holes extending into said third annular surface for reducing material usage in fabricating said combined core member and for enhancing interlocking between said combined core member and said base; and a plurality of positioning bosses disposed at the outermost point of said angularly spaced radial extensions for positioning said combined core member during said plastic wash basket fabrication.

19. A rotatable wash basket according to claim 14, wherein said combined core member is plastic.

20. An automatic washer comprising:

an imperforate tub;

a motor having an output shaft;

a drive system connectable with said output shaft and having a drive shaft; and a rotatable wash basket disposed within said imperforate tub, said wash basket further including:

an integral plastic body having a generally cylindrical outerwall defining a vertical axis and an upper end open for receiving clothes for wash treatment and a lower end, and further having a base for forming a bottom of said generally cylindrical outerwall and having an outer edge integral with said lower end of said generally cylindrical outerwall, and an annular core member disposed centrally within said base, such that said annular core member is encapsulated and interlocked within said base, said annular core member having an integral annular body and further including:

an inner annular portion, an outer annular portion, said outer portion being a plurality of angularly spaced radially extensions, a plurality of surfaces defining said integral annular body, said surfaces further including:

a first annular surface formed along said hub having an upper and lower end, a second annular surface substantially perpendicular to said vertical axis of said cylindrical member and extending outward from said lower end of said first annular surface toward said outer edge of said base, and a third annular surface interconnected with said second annular surface and extending at an acute angle upward and inward to said upper end of said first annular surface such that said first annular surface, said second annular surface and said third annular surface interconnect for forming a substantially triangular radial cross-section, a plurality of angularly spaced radial ribs extending from said third annular surface for enhancing interlocking between said annular core member and said base, a plurality of core holes extending into said third annular surface for reducing material usage in fabrication said annular core member and for enhancing interlocking between said annular core member and said base, and a plurality of positioning bosses disposed at the outermost point of said angularly spaced radial extensions for positioning said annular core member during said plastic wash basket fabrication;

a hub member disposed centrally within said annular core member, said hub means rigidly connectable with said drive shaft for rotating said wash basket, said hub member further including:

a generally cylindrical hollow portion having an axis aligned with said vertical axis, and having an upper and a lower end, said generally cylindrical hollow portion further having a first means for mechanically interlocking with said base, a substantially rectangular hollow portion intersecting said generally cylindrical hollow portion and having an open bottom corresponding to said lower end of said generally cylindrical hollow portion such that said generally cylindrical hollow portion and said substantially rectangular hollow portion define an interior cavity of said hub member having an open top end and open bottom end and further having a lower portion having a substantially rectangular cross-section and an upper portion having a substantially circular cross-section, said interior cavity further including means for rigidly interconnecting said hub member with said drive shaft, and a flange portion intersecting said lower end of said generally cylindrical hollow portion and said open bottom of said substantially rectangular hollow portion and further having a second means for mechanically interlocking with said base;

said base encapsulating said annular core member further including:

a first wall disposed above and interlocked with said second annular surface, and a second wall disposed above and interlocked with said third annular surface such that a vertical downward force applied to said outer edge of said base is opposed by placing said first wall in compression and said second wall in tension for eliminating bending and increased base rigidity.

21. A rotatable wash basket according to claim 20, wherein said hub member is metallic.

22. A rotatable wash basket according to claim 20, wherein said first means for mechanically interlocking with said base comprises a plurality of external axial ribs located on said lower end of said generally cylindrical hollow portion.

23. A rotatable wash basket according to claim 20, wherein said second means for mechanically interlocking with said base comprises a plurality of holes substantially coaxial with said vertical axis and located on said flange portion.

24. A rotatable wash basket according to claim 20, wherein said outerwall has a thickness of approximately 4 mm or less.

* * * * *